US007075503B2

(12) United States Patent
Shinohara

(10) Patent No.: US 7,075,503 B2
(45) Date of Patent: Jul. 11, 2006

(54) METHOD FOR ADJUSTING COLOR TEMPERATURE IN PLASMA DISPLAY PANEL

(75) Inventor: Masahiko Shinohara, Tokyo (JP)

(73) Assignee: LG Electronics Inc., Seoul (KR)

( * ) Notice: Subject to any disclaimer, the term of this patent is extended or adjusted under 35 U.S.C. 154(b) by 575 days.

(21) Appl. No.: 09/793,396

(22) Filed: Feb. 27, 2001

(65) Prior Publication Data

US 2002/0011795 A1 Jan. 31, 2002

(30) Foreign Application Priority Data

Feb. 29, 2000 (JP) ..... 2000-053898

(51) Int. Cl.
*G09G 3/28* (2006.01)

(52) U.S. Cl. ..... 345/60; 345/63

(58) Field of Classification Search ..... 345/30, 345/37, 42, 51, 55, 60, 67–68, 72, 204, 690–691, 345/63; 315/169.1, 169.3, 169.4, 167; 313/582, 313/584–586, 631, 491, 495; 348/674, 671; 445/24

See application file for complete search history.

(56) References Cited

U.S. PATENT DOCUMENTS 5,442,355 A * 8/1995 Cummins ..... 341/145
6,215,468 B1 * 4/2001 Van Mourik ..... 345/605
6,300,931 B1 * 10/2001 Someya et al. ..... 345/102
6,344,857 B1 * 2/2002 Matono et al. ..... 345/600
6,380,943 B1 * 4/2002 Morita et al. ..... 345/589
6,429,905 B1 * 8/2002 Yamamoto ..... 348/656
6,476,801 B1 * 11/2002 Nagai ..... 345/213
6,555,955 B1 * 4/2003 Honda ..... 313/489

FOREIGN PATENT DOCUMENTS

| | | | |
|---|---|---|---|
| JP | 10-333639 | | 12/1998 |
| JP | EP 1 065 648 | A2 * | 1/2001 |
| JP | 2001-175220 | * | 6/2001 |
| JP | 2001-324971 | * | 11/2001 |
| WO | WO 00/70597 | * | 11/2000 |

* cited by examiner

*Primary Examiner*—Amr A. Awad
*Assistant Examiner*—Leonid Shapiro
(74) *Attorney, Agent, or Firm*—Fleshner & Kim, LLP

(57) ABSTRACT

A method is provided for adjusting color temperature in a PDP device. The method includes setting a desired color temperature of the PDP as the RGB ratio which shows the level ratio of each of the RGB signals, setting each light emitting frequency of the PDP corresponding to the level of each of the A/D converted RGB signals, and selecting a subfield of gradation frequency corresponding to the set light emitting frequency to control the light emitting of the PDP. According to the method, the color temperature can be adjusted without lowering the gradation in the PDP.

9 Claims, 2 Drawing Sheets

METHOD FOR ADJUSTING COLOR TEMPERATURE IN PLASMA DISPLAY PANEL

BACKGROUND OF THE INVENTION

1. Field of the Invention

The present invention relates to a method for adjusting color temperature in a PDP (Plasma Display Panel).

2. Description of the Related Art

In a picture receiver such as a cathode ray tube (CRT) or a PDP, several color temperatures can be adjusted within a temperature range of about 6000° C. to 12,000° C. so that the color temperature can be varied according to user's taste.

Such color temperatures of a display screen of the picture receiver can be adjusted variably by changing the level of each of RGB (red-green-blue) signals. Here, in the case of a picture receiver using the PDP, each of the RGB signals is subjected to level converting color temperature change before an analog input image signal is A/D (analog-to-digital) converted.

FIG. 4 shows an example of a picture receiver using the PDP as a display unit. The PDP is comprised of level adjustors 10A to 10C for changing the level of each of RGB signals in an input image signal a, A/D converters 11A to 11C for A/D converting the level of each of the RGB signals adjusted by the level adjustors 10A to 10C, a γ converting unit 12 for the luminance of each of the A/D converted RGB digital signals to be varied linearly, a luminous subfield selecting unit 13 for selecting a subfield corresponding to the luminance of each of the γ converted RGB digital signals, and a drive unit 14 for driving the PDP 15 according to the gradation frequency of the subfield selected by the luminous subfield selecting unit 13 to display the gradation of the PDP 15.

Here, when the user sets a desired color temperature, gains of the level adjustors 10A to 10C are reduced corresponding to the input level ratio of each of the RGB signals. This adjusts the level of each of the RGB signals from the level adjustors 10A to 10C. The level of each of the RGB signals adjusted by each of the level adjustors 10A to 10C is A/D converted by each of the A/D converters 11A to 11C, and sent to the γ converting unit 12 as each of the RGB digital signals. The γ converting unit 12 performs a γ conversion so that the luminance of the input digital signals can be linearly varied as described above, the luminous subfield selecting unit 13 selects the subfield corresponding to the level of each of the γ converted RGB signals, and the drive unit 14 drives the PDP 15 based upon the gradation frequency or the light emitting frequency selected by the luminous subfield selecting unit 13 and displays the gradation of the PDP 15.

The PDP device of the related art reduces the gain of the level adjustors 10A to 10C in response to the input level ratio of each of the RGB signals when the user sets a desired color temperature. Therefore, a problem takes place that the gradation of the PDP is lowered if the output level of each of the level adjustors 10A to 10C is lowered under the dynamic range of the A/D converter.

SUMMARY OF THE INVENTION

It is therefore an object of the present invention to enable adjustment of the PDP color temperature without lowering the PDP gradation.

According to an embodiment of the present invention to obtain the foregoing object, it is provided a method for adjusting color temperature in a PDP device which A/D converts each of the RGB signals from input signals, γ converts each of the A/D converted RGB signals, selects a subfield corresponding to the level of each of the γ converted RGB signals, and controls the light emitting of a PDP according to the light emitting frequency of the selected subfield to display the gradation of the PDP, the method comprising the following steps of: setting a desired color temperature of the PDP as the RGB ratio which shows the level ratio of each of the RGB signals; setting each light emitting frequency of the PDP corresponding to the level of each of the A/D converted RGB signals; and selecting a subfield of gradation frequency corresponding to the set the light emitting frequency to control the light emitting of the PDP.

Here, the step of setting each light emitting frequency includes a step of increasing the light emitting frequency of another signal based upon a signal which has the smallest RGB ratio in each of the A/D converted RGB signals.

Also, the method can comprise the following steps of: setting a desired color temperature of the PDP as the RGB ratio which shows the level ratio of each of the RGB signals; calculating corresponding relation of the level of each of the A/D converted input RGB signals with the level of each of the γ converted output RGB signals and preparing a table for each of calculation results; and selecting each of the tables prepared by a plurality of color temperatures according to the color temperature selecting signal and selecting a subfield corresponding to the selected table at the same time to control the light emitting of the PDP.

Furthermore, the method can comprise the following steps of: setting a desired color temperature of the PDP as the RGB ratio which shows the level ratio of each of the RFB signals; calculating each of the light emitting frequencies of the PDP corresponding to the level of each of the γ converted RGB signals based upon the RGB ratio and preparing a table for each of calculation results; and selecting each of the tables prepared by a plurality of color temperatures according to the color temperature selecting signal and selecting a subfield corresponding to the selected table at the same time to control the light emitting of the PDP.

DETAILED DESCRIPTION OF THE PREFERRED EMBODIMENT

Figure 1:
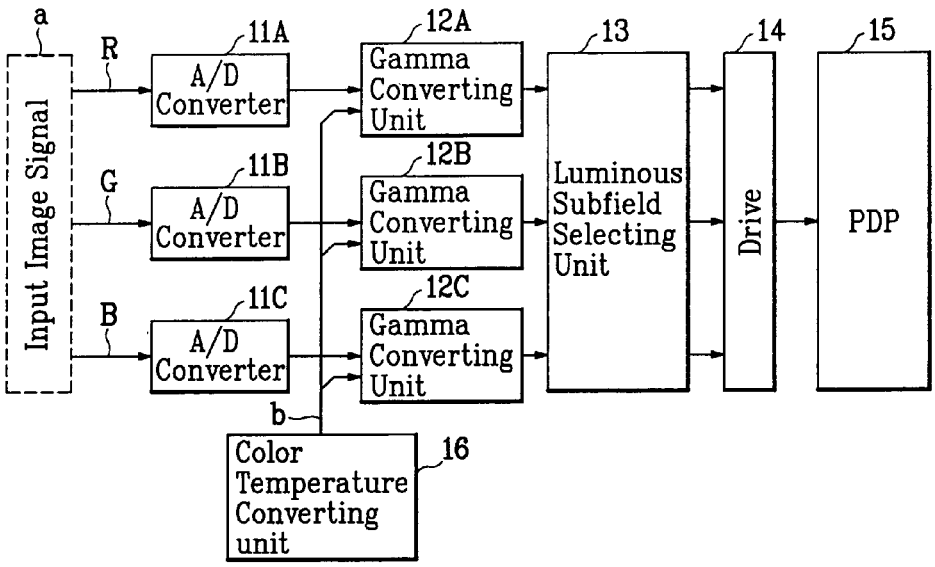
FIG. 1 is a block diagram for showing a PDP device using a color temperature adjusting method according to first embodiment of a PDP of the invention.

Hereinafter it will be described about the present invention in reference to the appended drawings:

FIG. 1 is a block diagram for showing a PDP device using a color temperature adjusting method according to first embodiment of a PDP of the invention;

The PDP device shown in FIG. 1 uses a PDP as a display unit, and is comprised of A/D converters 11A to 11C for A/D converting the level of each of RGB signals in an input image signal a, γ converters 12A to 12C for using an internal reference table to γ convert the luminance of each of RGB digital signals linearly, a luminous subfield selecting unit 13 for selecting the following subfield corresponding to the level of each of the γ converted RGB digital signals, a drive unit 14 for driving the PDP 15 according to the gradation frequency selected by the luminance subfield selecting unit 13 and displaying the gradation of the PDP 15, and a color temperature selecting unit 16.

In the PDP device constructed like this, the level of each of the RGB signals constituting the input image signal a is A/D converted by each of the A/D converters 11A to 11C to be sent to each of the γ converting units 12A to 12C as each of the RGB digital signals, respectively, as described above. Each of the γ converting units 12A to 12C converts the luminance of each of the input digital signals based upon the internal reference table and transmits the converted signals to the luminous subfield selecting unit 13. The luminous subfield selecting unit 13 selects the subfield having the gradation frequency corresponding to the level of each of the γ converted RGB signals and at the same time drives the PDP 15 corresponding to the selected subfield gradation frequency, and thereby performing the gradation display of the PDP 15.

Generally in the case of displaying image data of N bit by using this kind of PDP 15, one frame is divided into N+2 to N+4 number of subfields. In each subfield, the luminous frequency or the light emitting frequency is weighted as the gradation frequency, and the gradation of an N bit image is displayed according to composition or combination of each subfield. For example, when an 8 bit image is displayed, generally one frame is divided into 10 to 12 subfields and the largest number of the total the light emitting is about 1000.

While the N bit input image data are converted into luminous/non-luminous data of each subfield or converted into the light emitting frequency data to display the gradation, as can be seen in the second embodiment according to the invention, each of the inputted RGB signals is converted respectively and the light emitting frequency can be varied for each of R, G and B about each of the input signals to adjust the color temperature. Also, in order to have a desired color temperature, the light emitting frequency is increased according to the level ratio of the RGB so that the color temperature can be adjusted without lowering the gradation of PDP 15.

For example, if the RGB level ratio is 1:1.2:1.4 for obtaining a necessary color temperature in 8 bit input signal, the ratio of the RGB light emitting frequencies is 255:306:357 in 100% white state.

Each of the light emitting frequencies is varied about each of RGB to adjust the color temperature.

Hereinafter, it will be described about main operations of the PDP device shown in FIG. 1:

In the PDP device shown in FIG. 1, each of the RGB signals is inputted to each of the A/D converters 11A to 11C with same gain to be suitable to the dynamic range of each of the A/D converters 11A to 11C. Each of the A/D converters 11A to 11C converts the level of each of the inputted RGB signals to each of digital values and sends each of the converted values to each of the γ converting units 12A to 12C. Each of the γ converting units 12A to 12C γ converts each of the RGB digital values based upon the reference table. This can perform a conversion to data according to each of the RGB signals.

Here, the color temperature selecting unit 16 selects the reference table of each of the γ converting units 12A to 12C so that the output value is the same as the RGB ratio of the necessary or desired color temperature in respect to the data which are γ converted according to each RGB signal.

In other words, when the RGB ratio of the necessary color temperature is 1:1.2:1.4, if all of the levels of the RGB input signal to the γ converting units 12A to 12C are 255 for example, corresponding output signals of the γ converters 11A to 11C are: R=255, G=255×1.2=306, and B=255×1.4=357. Here, it is necessary that the output characteristics in the γ converters 12A to 12C be calculated with each of R=255, G=306 and B=357 being as 100%.

A data table is prepared about each of the necessary color temperatures like this and contained or stored as a reference table in the corresponding γ converting unit 12, and the table is replaced by a color temperature selecting signal b from the color temperature selecting unit 16 based upon the setting operation of the user for change into a necessary color temperature so that the color temperature can be adjusted.

In this way, each of the RGB signals which is outputted from each of the γ converting units 12A to 12C and adjusted into the necessary color temperature is inputted into the luminous subfield selecting unit 13. The luminous subfield selecting unit 13 can respond to the maximum level of each of the inputted RGB signals. The maximum level of B is 357 in the foregoing example, 357 gradation subfield is selected corresponding to the maximum level of 357 and sent to the drive unit 14, which displays the gradation of the PDP 15.

Also in this case, each subfield corresponding to each of the RGB signals is selected and sent to the drive unit 14, which displays the gradation of the PDP 15.

Figure 2:
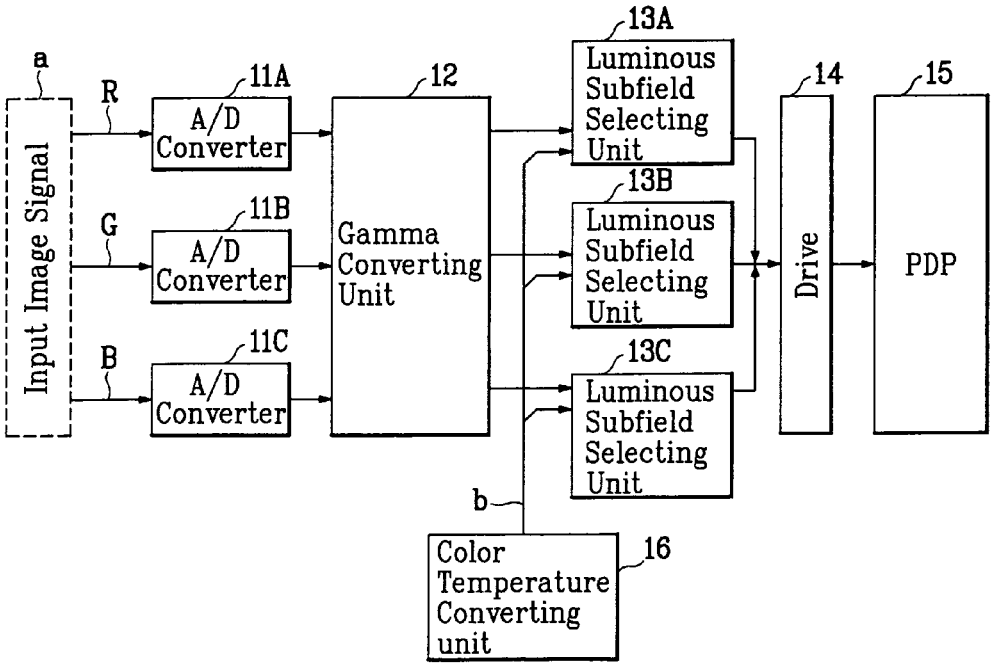
FIG. 2 is a block diagram for showing a PDP device using a color temperature adjusting method according to second embodiment of a PDP of the invention.

Now, FIG. 2 is a block diagram for showing a second embodiment of the PDP device. In the PDP device shown in FIG. 2, each of RGB signals is inputted into each of A/D converters 11A to 11C with the same gain to be suitable to the dynamic range of each of the A/D converters 11A to 11C as in the PDP device shown in FIG. 1. Each of the A/D converters 11A to 11C converts each of the inputted RGB signal levels into digital values and sends them to a γ converting unit 12.

Here, the γ converting unit 12 γ converts each of the inputted RGB digital values based upon the same reference table with R, G, B. For example, if the input signal is 8 bit, a value with the level 255 of the output signal calculated as 100% is set as a table value in the reference table of the γ converting unit 12.

Each of the RGB level values which are γ converted on the basis of the same reference table of the γ converting unit 12 is sent to each of corresponding luminous subfield selecting circuits 13A to 13C where a subfield is selected for each of R, G and B corresponding to a necessary color temperature.

Each of the luminous subfield selecting circuits selects a subfield having the total light emitting frequency which is the same as the RGB ratio of the necessary color temperature. For example, when the RGB ratio of the necessary color temperature is 1:1.2:1.4, if input signal level are 255 for all of R, G and B, the light emitting frequencies are 255 for R, 306(255×1.2) for G and 357(255×1.4) for B.

Here, the subfield selecting tables are prepared as many as setting numbers of the color temperatures necessary for each of the luminous subfield selecting circuits 13A to 13C, and replaced by the color temperature selecting signal b from the color temperature selecting unit 16 based upon the setting operation of a user to select a subfield having corresponding gradation frequency for each of the RGB signals.

This causes the drive unit 14 to drive the PDP 15 based upon the gradation number of the selected subfield and show the gradation of the PDP 15.

Figure 3:
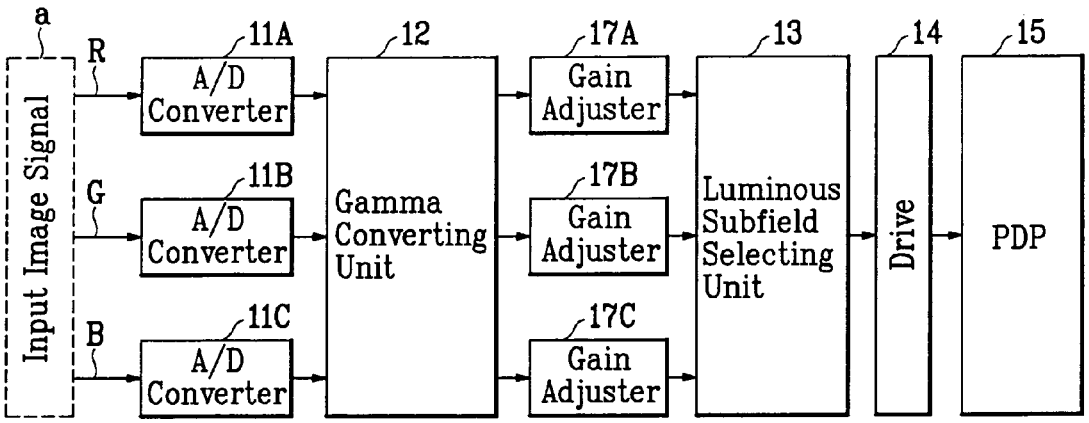
FIG. 3 is a block diagram for showing a PDP device using a color temperature adjusting method according to third embodiment of a PDP of the invention.
Figure 4:
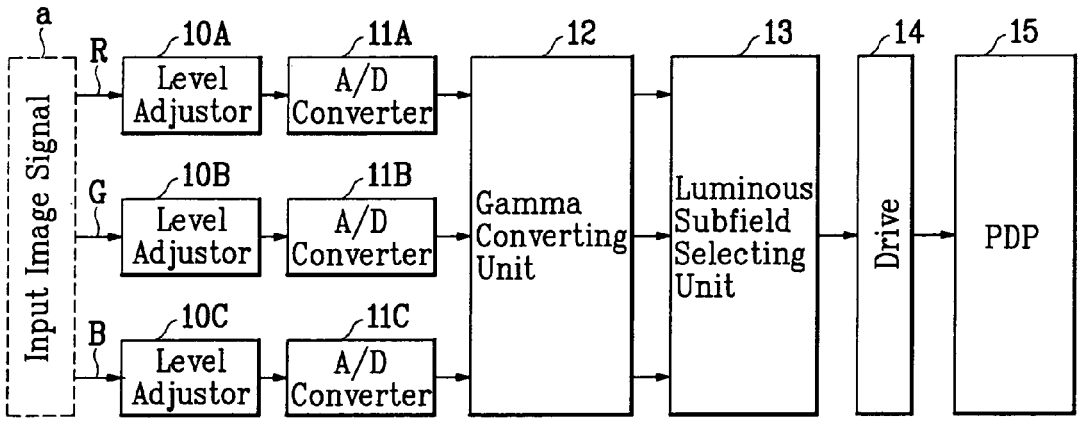
FIG. 4 Related Art
FIG. 4 is a block diagram for showing a PDP device according to the related art.

Next, FIG. 3 is a block diagram for showing third embodiment of the PDP device. While the subfield selecting tables which relate the light emitting frequency and the selected subfield to each of the luminous subfield selecting circuits 13A to 13C are prepared as many as the necessary color temperature number and are replaced by the color temperature b from the color temperature selecting unit 16 to select a subfield having corresponding gradation number in the PDP device shown in FIG. 2, in the PDP device shown in FIG. 3, gain adjustors 17A to 17C are installed to adjust the gain of each of the RGB signals instead of each of the luminous subfield selecting circuits 13A to 13C of FIG. 2.

When the necessary color temperature is adjusted based upon the setting operation of the user, the gain adjustors 17A to 17C adjust the gain of each of the RGB signals from the converting unit 12 to have the same level ratio as the RGB ratio of the necessary color temperature. In other words, when the RGB ratio of the necessary color temperature is 1:1.2:1.4, each of the gain adjustors 17A to 17C adjusts the gain of each of the RGB signals from the γ converting unit as 1:1.2:1.4 and sends the adjusted gain to a luminous subfield selecting unit 13. The luminous subfield selecting unit 13 selects each subfield corresponding to the gain of each of the RGB signals. The drive unit 14 drives the PDP 15 based upon the gradient number of the selected subfield and displays the gradation of the PDP 15. In this way, the color temperature can be adjusted freely without lowering the gradation of the PDP 15.

According to the present invention as described above, in the device which A/D converts each of the RGB signals for red, green and blue colors, γ converts each of the A/D converted RGB signals, selects a subfield corresponding to the level of each of the γ converted RGB signals, and controls the light emitting frequencies of the PDP according to the gradation number of the selected subfield to display the gradation of the PDP, the desired color temperature of the PDP is set as the RGB ratio showing the level ratio of each of the RGB signals, each of the light emitting frequencies corresponding to the level of each of the converted RGB signals is set based upon the RGB ratio, and the subfield of the gradation number corresponding to the set light emitting number is selected to control the light emitting of the PDP. Therefore, when adjusting the color temperature of the PDP, the level of each of the RGB signals inputted into the A/D converter is not adjusted as in the related art so that the color temperature can be adjusted without lowering the gradation of the PDP.

Also, the light emitting frequency of the G and B signals are increased based upon the R signal having the lowest value of the RGB ratio in the A/D converted RGB signals so that the lowering of the PDP gradation can be prevented in adjusting the color temperature of the PDP.

Also, the corresponding relation to each of the A/D converted input RGB signals with each of the γ converted output RGB signals is calculated based upon the RGB ratio, the calculation results are prepared in tables, each of the tables prepared according to a plurality of color temperatures is selected according to the color temperature selecting signal, and the subfield is selected corresponding to the selected table to control the light emitting of the PDP, so that the color temperature can be adjusted without lowering the PDP gradation.

Also, each of the light emitting frequency of the PDP corresponding to each of the γ converted RGB signals is calculated according to the RGB ratio, the calculation results are prepared in tables, each of the tables prepared according to a plurality of color temperatures is selected according to the color temperature selecting signal, and the subfield is selected corresponding to the selected table to control the light emitting of the PDP, so that the color temperature can be adjusted without lowering the PDP gradation.

What is claimed is:

1. A method for adjusting color temperature in a PDP device, comprising:

converting an input image signal to RGB signals;

establishing a ratio of levels of the RGB signals that will produce a desired color temperature for the PDP device;

A/D converting the input RGB signals and then γ converting the A/D converted input RGB signals, wherein γ converting the A/D converted input RGB signals comprises γ converting each RGB signal in a separate γ converting unit based on a color temperature selecting signal generated by a color temperature selecting unit;

selecting light emitting frequencies for each of the RGB signals based on the ratio of levels of RGB signals; and selecting a subfield gradation frequency corresponding to the selected light emitting frequency for each of the RGB signals, wherein the ratio of levels of the RGB signals is maintained at the established level so as to maximize a brightness level of the PDP.

2. The method according to claim 1, wherein the step of selecting light emitting frequencies for each of the RGB signals comprises selecting light emitting frequencies for each of the RGB signals based on the selected ratio.

3. The method according to claim 1, wherein the step of selecting light emitting frequencies for each of the RGB signals comprises selecting light emitting frequencies based on a reference table of RGB ratios corresponding to various color temperatures.

4. The method according to claim 1, wherein the step of selecting a subfield gradation frequency corresponding to the selected light emitting frequency for each of the RGB signals comprises selecting a subfield gradation frequency corresponding to the selected light emitting frequency for each of the RGB signals based on the selected ratio.

5. The method according to claim 1, wherein the step of selecting a subfield gradation frequency corresponding to the selected light emitting frequency for each of the RGB signals comprises selecting a subfield based on a reference table of RGB ratios corresponding to various color temperatures.

6. The method according to claim 1, further comprising adjusting the gain of each of the RGB signals based on the selected ratio, wherein the step of selecting a subfield gradation frequency corresponding to the selected light emitting frequency for each of the RGB signals comprises selecting a subfield gradation frequency corresponding to the selected light emitting frequency for each of the adjusted RGB signals.

7. The method according to claim 1, wherein selection of light emitting frequencies for each of the RGB signals are based on the color temperature selecting signal.

8. A method for adjusting color temperature in a PDP device, comprising:

converting an input image signal to RGB signals;

establishing a ratio of levels of the RGB signals that will produce a desired color temperature for the PDP device;

A/D converting the input RGB signals and then γ converting the A/D converted input RGB signals;

selecting light emitting frequencies for each of the RGB signals based on the ratio of levels of RGB signals; and selecting a subfield gradation frequency corresponding to the selected light emitting frequency for each of the RGB signals, wherein the ratio of levels of the RGB signals is maintained at the established level so as to maximize a brightness level of the PDP, and whrein selecting a subfield gradation frequency comprises selecting a luminous subfield for each RGB signal in a separate luminous subfield selecting unit based on a color temperature selecting signal generated by a color temperature selecting unit.

9. A method for adjusting color temperature in a PDP device, comprising:

converting an input image signal to RGB signals;

establishing a ratio of levels of the RGB signals that will produce a desired color temperature for the PDP device;

A/D converting the input RGB signals and then γ converting the A/D converted input RGB signals;

selecting light emitting frequencies for each of the RGB signals based on the ratio of levels of RGB signals;

selecting a subfield gradation frequency corresponding to the selected light emitting frequency for each of the RGB signals, wherein the ratio of levels of the RGB signals is maintained at the established level so as to maximize a brightness level of the PDP; and adjusting a gain of each of the γ converted RGB signals prior to selecting a subfield of gradation frequency such that a resulting RGB ratio is the same as an RGB ratio associated with the desired color temperature.

* * * * *